US011519666B2

(12) United States Patent
MokhtarzadehBahadorani

(10) Patent No.: US 11,519,666 B2
(45) Date of Patent: Dec. 6, 2022

(54) SHIPMENT OF MRNA MATERIAL WITH DRY ICE AS THE COOLANT

(71) Applicant: TCP RELIABLE, INC., Edison, NJ (US)

(72) Inventor: Nima MokhtarzadehBahadorani, Montreal (CA)

(73) Assignee: INTEGREON GLOBAL, INC., Short Hills, NJ (US)

( * ) Notice: Subject to any disclaimer, the term of this patent is extended or adjusted under 35 U.S.C. 154(b) by 80 days.

(21) Appl. No.: 17/169,635

(22) Filed: Feb. 8, 2021

(65) Prior Publication Data

US 2022/0252336 A1 Aug. 11, 2022

(51) Int. Cl.
*F25D 29/00* (2006.01)
*F25D 3/14* (2006.01)

(52) U.S. Cl.
CPC ..... *F25D 29/003* (2013.01); *F25D 3/14* (2013.01); *F25D 2700/14* (2013.01)

(58) Field of Classification Search
CPC ..... F25D 29/003; F25D 11/003; F25D 3/125; F25D 3/14; F25D 2700/14; F25D 3/12
See application file for complete search history.

(56) References Cited

U.S. PATENT DOCUMENTS

2007/0227913 A1* 10/2007 Shoenfeld ..... E05B 63/24 206/1.5
2013/0213977 A1* 8/2013 Stathes ..... B65D 81/3848 428/69
2015/0120597 A1* 4/2015 Dertadian ..... F25D 3/08 705/332
2017/0350635 A1* 12/2017 Thirumurugavel ..... F16K 17/04
2021/0033331 A1* 2/2021 Lowe ..... G06Q 10/0832

* cited by examiner

*Primary Examiner* — Brian M King
(74) *Attorney, Agent, or Firm* — Eric P. Mirabel

(57) ABSTRACT

Disclosed is a method of maintaining an initial quantity of mRNA vaccine cargo in an EPS container containing dry ice as a passive coolant during shipment from a manufacturing site, wherein the initial quantity of mRNA vaccine cargo is shipped to a first depot and then repackaged into smaller quantities at one or more additional depots en route to the final destinations. Dry ice can be added or ordered in advance to be available at the next depot for the cargo. Indicators show the status of the cargo and whether it has undergone unacceptable temperature or humidity excursions.

14 Claims, 2 Drawing Sheets

SHIPMENT OF MRNA MATERIAL WITH DRY ICE AS THE COOLANT

BACKGROUND

Shipment of mRNA and mRNA vaccine materials is problematic because, for example, Pfizer's promising COVID-19 mRNA vaccine must be stored at about −70° C. (−94° F.). Some of the other COVID-19 MRNA vaccines can tolerate somewhat higher temperatures (Moderna's mRNA-1273 requires at least −20° C.) but all such mRNA materials require temperatures below freezing (below 0° C.) for preservation.

Sustained temperatures low enough even for Pfizer's COVID-19 mRNA vaccine can be achieved using dry ice in expanded polystyrene (EPS) container systems—termed a "passive" refrigeration system. However, distribution of vaccines requires shipment in bulk to distribution centers, and then re-packaging one or more times into smaller quantities before the vaccines reach the final destination (pharmacies, hospitals or clinics, where administration to patients takes place). The re-packaging requires re-evaluation of the quantity of dry ice and the appropriate container each time the cargo is re-packaged en route to the final destination, in order to maintain the required storage temperature. The ambient temperature significantly affects the sublimation rate of the dry ice, and thus, the period during which the mRNA cargo can be in shipment before an unacceptable temperature excursion takes place; i.e., where the ambient temperature exceeds a threshold for a given period.

Time in shipment can only be estimated, as there are many sources of delay during shipment, both conventional and unexpected. Also, the temperature during shipment can only be estimated based on expected weather conditions and knowledge of shipment mode internal temperatures and warehouse temperatures. If a shipment of blood or biological products is delayed, and/or the temperature varies beyond expectation during shipment for more than a prescribed period, it is important to determine how much time is left before the quantity of refrigerant is insufficient to sustain the required storage temperature. Verification of appropriate shipping conditions (esp. temperature) is also needed for regulatory compliance.

Thus, use of passive refrigeration systems requires monitoring, and constant re-evaluation of the coolant quantities, especially where there is product re-packaging en route. Indicators should be associated with shipment temperature and/or humidity monitoring to indicate when specified shipment conditions have been violated and the vaccine cargo cannot be used.

SUMMARY

The invention relates to maintaining passive cooling to preserve an mRNA vaccine cargo in an EPS container containing dry ice as a passive coolant during shipment from a manufacturing site (or a proximal cold-storage warehouse) to a number of final destinations, wherein the initial quantity of mRNA is shipped to a first depot first, and then to one or more additional depots. At each additional depot the cargo is repackaged in smaller quantities en route to the final destinations. The repackaging can take place a number of times before the final destinations (hospitals, clinics, pharmacies, or medical professional's offices) where the vaccine is administered to patients.

A programmed computer determines how much initial dry ice is needed in a particular shipping container in order to maintain the required temperature for the cargo for an estimated period, $t_E$. The estimated period $t_E$ is the time limit for the container and cargo to reach a depot and then remain there until the package can be: monitored, or, opened and the cargo can be re-packaged, or, the cargo can be placed in cold storage, or, more dry ice can be added. Alternatively, if the remaining dry ice is insufficient to maintain the cargo required temperature, the shipment can be diverted to a nearby but not originally intended destination, where the mRNA vaccine can be administered to patients at that site more immediately than originally planned.

The monitoring and prediction described herein therefore allows one to take action to retain the value of mRNA vaccine as the refrigerant level drops and shortens the effective life of the cargo. The amount of initial dry ice is based on, first, the configurations of a particular container, which remain constant; in particular, the surface area of container thermal contact, and the inverse of the wall thickness of the container. Further, the amount of dry ice is based on $t_E$ and the predicted ambient temperature (and preferably, the predicted ambient humidity). The ambient temperature (and preferably also ambient humidity) actually encountered by the container is tracked using a monitor attached to or associated with the shipment container. The ambient temperature of concern is the ambient temperature experienced by the container during shipment and storage en route—not necessarily the environmental ambient temperature (though that may be related to the ambient temperature experienced by the container; where the shipping or warehousing en route is not climate controlled).

Following arrival at the first depot, or before (if the monitor is actively transmitting temperature and humidity data en route) the data from the monitor of actual ambient temperature, humidity and actual shipment time $t_s$ is used to determine how much dry ice should be added to the shipping container at the first depot for preservation of the cargo, unless the cargo was already re-packaged within period $t_E$. That is, if the actual, monitored ambient temperature, or the actual ambient temperature at a specified humidity, is greater than a predicted level for a specified period $P_s$, dry ice must be added immediately to the initial container to maintain the cargo. But even if the actual, monitored ambient temperature, or the ambient temperature at a specified humidity, is no greater than a predicted level during $t_s$, the cargo must still be re-packaged or dry ice must be added within period $t_E$.

At any depot where the cargo is re-packaged, the dry ice for the container used in re-packaging is calculated as above; where the dry ice needed is each time determined by the programmed computer to be sufficient to reach the next depot (based on predicted $t_E$ and predicted ambient temperature or ambient temperature at a specified humidity) and remain there for a period until that package can be monitored, or, opened and the cargo can be re-packaged, or, the cargo can be placed in cold storage, or, more dry ice can be added.

The estimated time $t_E$ is estimated by the programmed computer following heuristic determinations of dry ice sublimation rate ($DI_R$) in EPS containers of varying surface area and wall thickness (collectively, $W_T$) at varying actual ambient temperature ($T_A$) and actual humidity ($H_A$), as needed to solve the function:

$(DI_R)=f(W_T,T_A,H_A)$, and $t_E=f(DI_R)$, where $t_E$ is inversely proportional to $DI_R$ at constant values of $W_T,T_A$ and $H_A$.

A method to directly solve the above functions is to construct a series of sublimation curves from experimental data having sublimation rate as one axis, and three or four other dimensional axes: time, EPS container surface area and wall thickness, and temperature (or preferably, temperature and humidity).

The above equation is used to alter a server/computer's function wherein the data about ambient temperature (and preferably also ambient humidity) from the monitor during shipment is collated by a server (during shipment if the parameters are actively monitored and data is actively transmitted; or after arrival if the monitoring is passive and the data is stored by the monitor) that applies the solved function above to determine $DI_R$ and then determine (and if the data is actively monitored in real time, continuously update) the interval to needed addition of dry ice.

The programmed computer can be associated with the temperature and/or humidity monitor directly (integrated with it, for example) or can remotely receive and analyze the data collected by the monitor. The can provide programmed computer alerts as sound and/or visual indicators, e.g., lights or readable displays, when: a. the thresholds for temperature or humidity have been violated and the cargo should be discarded or rejected by the user; b. when the thresholds for temperature or humidity have not been violated and the cargo is suitable for use; or c. when addition of dry ice is needed or will be needed soon.

As a final step, the programmed server/computer also preferably invoices the customer after the cargo arrives at each depot en route to the final destination, or after arrival at the final destination. The invoicing is preferentially linked to an automated payment system which transfers funds to the shipper as soon as the invoice is received by the customer.

DETAILED DESCRIPTION

Figure 1A:
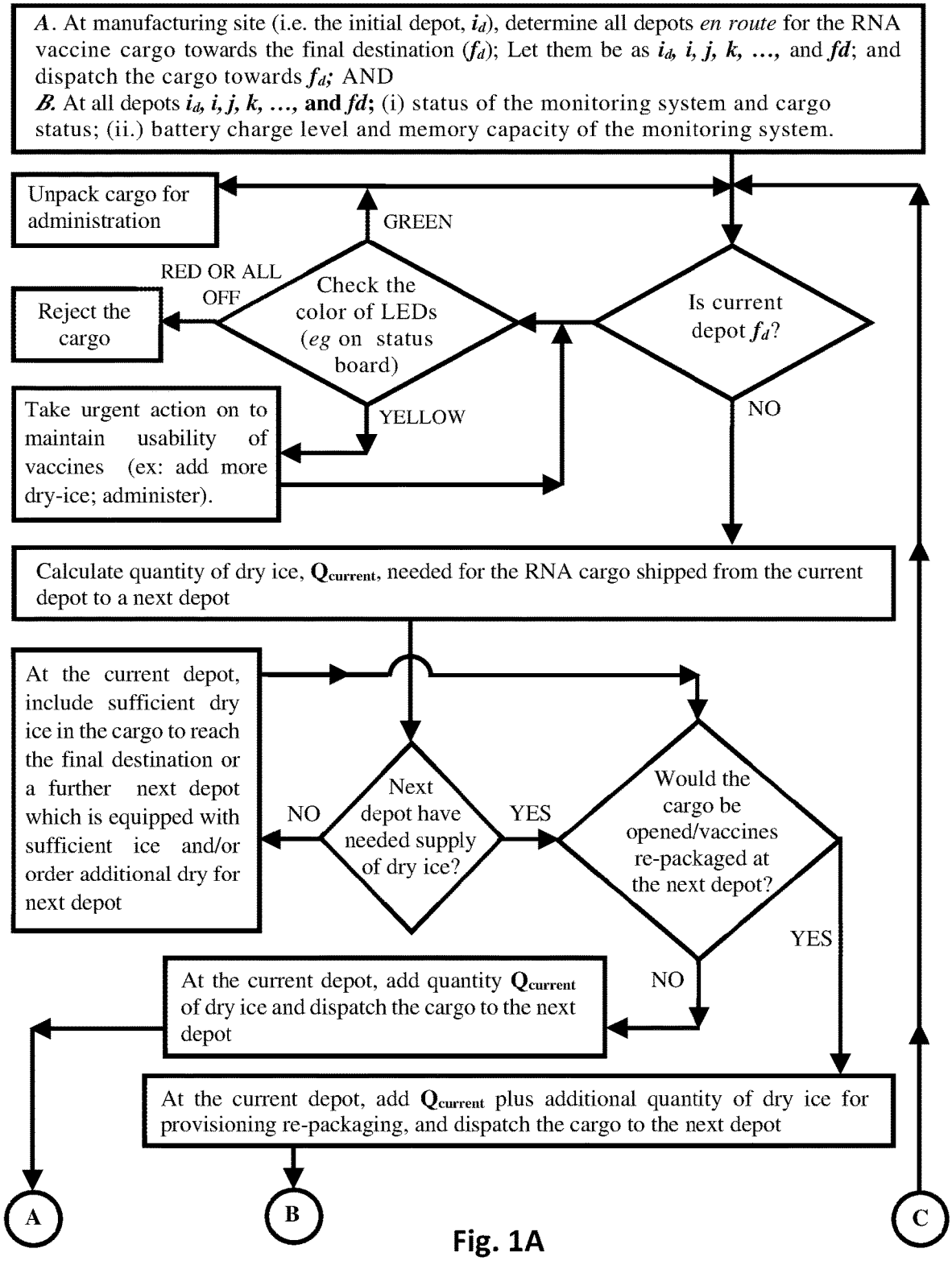
FIG. 1A to 1B is a flow chart of the steps from determining the amount of dry ice for the initial shipment, and re-determining at depots en route to the final destination for a cargo of mRNA vaccine, further demonstrating ordering dry ice in advance and adding it at various locations en route, and further illustrating using indicators for determination of whether shipment conditions were violated and taking actions based on indicators.

In using passive cooling to preserve an mRNA vaccine cargo in an EPS container containing dry ice as a passive coolant during shipment from a manufacturing site to a number of final destinations, wherein the initial quantity of mRNA is shipped to a first depot first, and then to one or more additional depots, the determination of how long dry ice can sustain the cargo depends on the relationship between the predicted ambient temperature and humidity for the EPS container, and the container's wall thickness and surface area; all of which affect dry ice sublimation rate within the shipping container. A larger temperature gradient (at a higher humidity) and a decreased container wall thickness and an increased surface area, will result in more rapid sublimation of the dry ice. The amount of dry ice in the container depends on sublimation rate and the shipment period, $t_s$.

In the invention, a programmed computer determines the quantity of dry ice for the container prior to shipment based on EPS container wall thickness and surface area ($W_T$), and predicted ambient temperatures ($T_A$) and humidity ($H_A$), and estimated limit period $t_E$, whereafter dry ice must be added to the cargo. Variations among $T_A$ and $H_A$ and the actual ambient temperatures and humidity experienced by the container, and the actual shipment period $t_s$ are determined continuously by shipment monitoring. If the monitoring (passive or active) indicates that the remaining dry ice is insufficient to maintain the cargo (based on a heuristically determined dry ice sublimation rate at the monitored $T_A$ and $H_A$) action to preserve the cargo can be taken, including moving the cargo to a faster transportation mode, instructing the shipper to add dry ice, or diverting the shipment or moving the container (if it is in a warehouse) to a temperature-controlled environment (e.g., a climate controlled cargo hold in a train, airplane or truck). The action taken might also be diverting the shipment to a nearby facility where the mRNA vaccine can be used on site more immediately than originally planned.

Starting from the manufacturer, the bulk mRNA vaccine shipped to the first depot would then be subdivided and re-packaged several times en route to the consumer. At each re-packaging new dry ice would need to be added to the repackaged, subdivided cargo portions in their new containers; or sufficient dry ice would need to be shipped with the cargo emanating from the preceding depot such that enough remained for re-packaging each portion of the subdivided cargo. Accordingly, planning of the appropriate amount of dry ice in each container requires knowledge of the availability of dry ice at the immediate destination of each container. If insufficient dry ice is predicted, the server/program instructs ordering of additional dry ice at the next destination/depot. These steps and actions are depicted in FIG. 1.

The programmed computer, in order to determine the amount of dry ice required, also needs to determine the availability of dry ice at each depot for the original mRNA vaccine shipment and the subdivided portions thereof. For depots where dry ice is not readily available, sufficient dry ice must be included with the cargo at the preceding depot so that each repackaged cargo portion has enough to reach the next destination without violating the container's internal temperature threshold (known as a temperature excursion). Preferably, the internal container temperature is either monitored actively (readings transmitted to a monitoring station, using RF transmission) throughout shipment; or passively (datalogging devices which are analyzed periodically during shipment). In the latter case, the passive monitoring system stores the data and preferably includes an external display which, when approaching a temperature excursion, indicates that, so that appropriate action (including adding dry ice) can be taken. It is preferable that both temperature and humidity, rather than temperature alone, are monitored for excursions, as the both temperature and humidity will affect the sublimation rate and the combined effect of higher humidity and temperature may cause spoiling of the cargo even if the temperature thresholds alone were not violated. The display can include indicators, as in FIG. 1, where red indicates unacceptable excursions, yellow indicates ice should be added soon, or green, means there were no excursions and the cargo is safe for use.

Figure 1B:
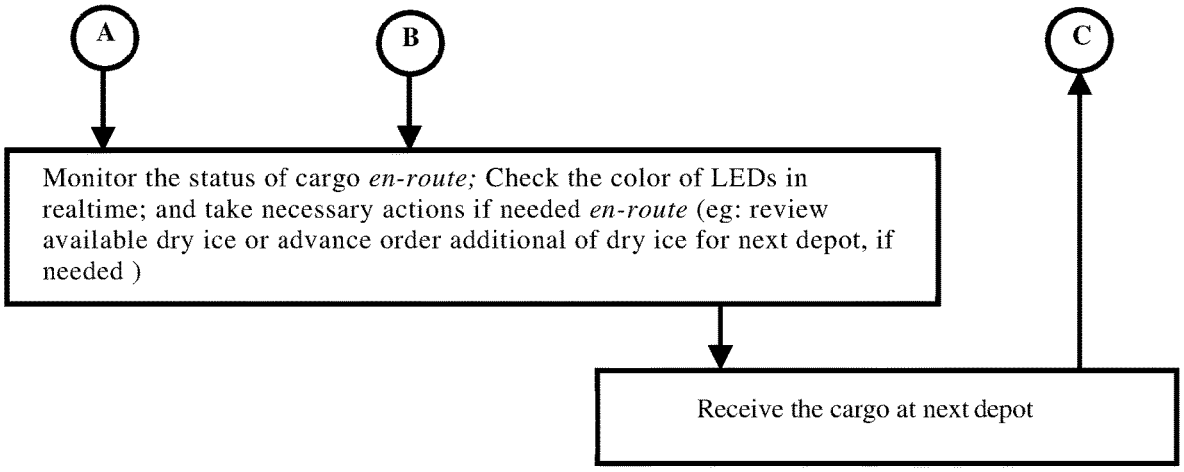

Referring to FIG. 1, the steps in the process are illustrated. At the initial step, from the manufacturing site (which is the initial depot, $i_d$), one makes an initial determination of the depots en route for the RNA vaccine cargo towards the final destination ($f_d$); which subsequent depots are designated i, j, k, etc. The cargo is shipped with a temperature monitor, or preferably a temperature and humidity monitor, which includes indicators (preferably LEDs on a separate board) which indicate whether unacceptable excursions have taken place, or whether addition of dry ice is needed soon. The indicators are checked before the cargo is delivered to $f_d$; and preferably, also before the cargo is delivered for local transport immediately before it reaches $f_d$.

As in the uppermost box in FIG. 1, the first two steps in the process are: A. At manufacturing site (i.e. the initial depot, $i_d$), determine all depots en route for the RNA vaccine cargo towards the final destination ($f_d$); Let them be as $i_d$), i, j, k, . . . , and $f_d$; and dispatch the cargo towards $f_d$; and, B. At all depots $i_d$, i, j, k, . . . , and $f_d$; determine (i) status of the monitoring system and cargo status; (ii.) battery charge level and memory capacity of the monitoring system. If at any time the battery charge level or memory capacity is so low as to endanger expected monitoring, the cargo must be rejected. In some cases, reviewing the existing monitoring data may all the cargo to be rehabilitated, provided new monitoring system and sent for administration or re-entered into the system in FIG. 1 for shipment.

The indicators can also indicate a warning ("yellow" in FIG. 1) meaning that monitoring shows the temperature or temperature and humidity tracking approaching excursion levels. At such levels, urgent action to save the cargo can be taken, such as adding more dry ice or sending the cargo to a final destination for immediate administration.

Where the indicators show that, based on temperature or temperature and humidity tracking, the cargo condition is acceptable, the cargo is either sent to a final destination for immediate administration or continued in the shipment chain headed to the next destination.

At each depot $i_d$, i, j, k, etc. one determines the amount of dry ice needed to reach the next depot, and makes a determination of the availability of dry ice at the next depot. If insufficient dry ice is available at the next depot, one either includes additional ice with the shipment to reach a further depot (or $f_d$) or instructs ordering or other supply of dry ice be available at the next depot or a further depot before the cargo reaches it.

The cargo is preferably also monitored en route, which may be reviewing the indicator data or actual temperature and humidity data from the monitor. If the monitoring indicates that action is needed en-route to preserve the cargo, that action is undertaken. Such action may include reviewing the available dry ice at the current depot, the next depot, or advance ordering of additional of dry ice to be available at the next depot.

Active monitoring may be needed for customer assurance, or to meet the FDA GMP requirements, as the mRNA vaccines are subject to FDA jurisdiction. The monitoring system may be designed to track and log the temperature and humidity automatically during shipment, if this is a requirement under applicable regulations. The temperature log can also be automatically documented, if this is a regulatory requirement or part of the standard operating procedures (SOPs) for regulated products.

Preferably, monitoring of the shipment can be performed from a remote location. In one modification of the method, the customer can perform the monitoring function themselves, and then decide themselves whether to take action to preserve the shipment while it is en route (i.e., they can decide whether to move the shipment to a faster transportation mode, instruct the shipper to add dry ice, or divert the shipment to a site for immediate use or move the system to a temperature-controlled environment).

As noted above, availability of sufficient dry ice at each depot (assuming most depots don't have a sufficiently cold freezer to maintain it indefinitely) also may require ordering sufficient dry ice in advance of shipment arrival. The programmed computer will preferably also generate requirements for dry ice ordering by each depot along the route to the final destinations for the cargo, based on the sublimation rate during the predicted shipment time from the dry ice supplier to each depot, and the predicted sublimation rate at each depot. The sublimation rate at each depot would be expected to be different than that during shipment because each depot would be expected to have some level of climate control available (though most would not have cold storage generating temperatures low enough to stop dry ice sublimation). Again, monitoring of the internal container temperature and humidity (passively or actively) is preferably used by the programmed computer to adjust the dry ice ordering and its timing for each depot. If the actual monitored internal container temperature indicates a need for more dry ice at the next depot for repackaging or for the container being monitored itself, the programmed computer can so indicate or trigger its ordering.

As noted above, sublimation curves constructed from experimental data can be used to predict the cargo life when the container is exposed to specified ranges of ambient temperatures (and humidity) for specified time periods. Another database may also be constructed to provide historic information on environmental ambient temperature and humidity along the predicted shipment routes, in different seasons. The database can be used in deriving the predicted temperatures ranges the container will be exposed to during shipment to each depot. As noted, the container is to be monitored during shipment to ascertain the cargo ambient temperature and time of exposure thereto, and preferably, there is also monitoring of the container's internal temperature during shipment—in order to verify the predictions, supplement the database, and provide protection for the cargo in case of unacceptable temperature excursions. If there are unacceptable temperature excursions, the cargo may need recall for re-testing for viability, or destruction.

Continuous monitoring an updating of the information can be done with a deep learning program, so that the results are use to actively improve the results of decisions on the parameters including packaging, dry ice quantities, shipment routes, carrier selection, warehouse selection and destinations for administration. All the parameters can be adjusted and changed in the system, so as to maximize the acceptable cargos of vaccine for administration.

An alternative to predicting ambient temperatures and the shipment period is to establish worst case scenarios—i.e., the predicted hottest environmental temperatures in summer, and the maximum predicted period of shipment/exposure based on destination; as well as the container wall thickness, surface area and dry ice quantity. Then, a container configuration and dry ice quantity is selected which will maintain the cargo within the predicted maximal temperature ranges; and it will necessarily also do so under generally-encountered shipping conditions in different seasons. Again, monitoring of the ambient container temperatures and humidity during shipment can be used in conjunction with such predictions to ascertain whether the cargo remains in an acceptable temperature range during shipment.

Monitoring systems can be used to verify or refute predicted temperatures and humidity, to establish or supplement a cold chain map along different shipment routes, and most importantly, to establish the effective amount of the remaining dry ice and determine if it will be effective over the expected remaining shipment time. The monitoring system can be under control of an internally stored program, or it can connect with an externally stored program.

An algorithm can be devised to determine on risk adjusted basis whether the system should maintain the mRNA cargo for the remainder of the shipment period $S_R$. When the data applied to the algorithm indicates, the server can display alternative scenarios, and an operator can select one which best satisfies the needs in a particular case: 1. Determine if the system can meet the worst case temperature and humidity range for $S_R$ without temperature excursion or dry ice addition; 2. determine the risk of cargo modification or destruction due to predicted or actually experienced temperature excursions; and 3. Where risk is above a cut-off level take action to preserve the cargo value (add dry ice, re-route, place in a freezer etc.).

At some point following arrival of mRNA vaccine at the final destination, if there were no unacceptable excursions of temperature or temperature and humidity; then, the vaccines would be tested to determine their suitability for use in patients or as reagents in assays or otherwise tested to determine their suitability for the purpose they were requested by the end-user. The effect of shipment on the products might be determined soon after arrival, or, their suitability for use in patients or as reagents may be tested well after arrival. In either case, a biological assay is performed on the vaccines to determine viability.

Unacceptable excursions of temperature or temperature and humidity are most likely at the local distribution system level, in the phase before the cargo reaches its final destination (where it is to be administered to patients). At this final phase, it is likely carried in a small vehicle which may not be refrigerated or well-insulated against the outside climate, which is especially problematic in summer. The monitoring system described herein is especially useful following such a journey of the cargo through a final phase. The indicators would show all unacceptable excursions, including any in the final phase.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, any of the terms "comprising", "including", containing", etc. are to be read expansively and without limitation. The methods and processes illustratively described herein suitably may be practiced in differing orders of steps, and that they are not necessarily restricted to the orders of steps indicated herein or in the claims. It is also noted that as used herein and in the appended claims, the singular forms "a," "an," and "the" include plural reference, and the plural include singular forms, unless the context clearly dictates otherwise. Under no circumstances may the patent be interpreted to be limited to the specific examples or embodiments or methods specifically disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants. The invention has been described broadly and generically herein. Each of the narrower species and subgeneric groupings falling within the generic disclosure also form part of the invention. The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A method of maintaining an initial quantity of mRNA vaccine cargo in an EPS container containing dry ice as a passive coolant during shipment from a manufacturing site, wherein the initial quantity of mRNA vaccine cargo is shipped to a first depot and then repackaged into smaller quantities at one or more additional depots en route to the final destinations, comprising:

providing the initial quantity of mRNA vaccine cargo in the EPS container;

providing the EPS container with dry ice estimated as sufficient to reach the first depot in order to maintain the mRNA vaccine cargo below a threshold temperature based on the predicted period for shipment of the cargo to the first depot, the predicted ambient temperature the container is exposed to, the wall thickness and surface area of the EPS container, by determining heuristically the relationship between the dry ice sublimation rate in EPS containers of varying wall thickness and surface area at varying ambient temperature for varying periods of time, and constructing a series of plots of said relationship, and then using the plots to estimate the sufficient dry ice;

monitoring the actual ambient temperature of the EPS container during shipment to the first depot;

if the actual ambient temperature experienced by the container is greater than a specified temperature for a specified period determined heuristically, such that insufficient dry ice is predicted to be present to maintain the cargo below a threshold temperature for a first additive period consisting of the remaining shipment period added to the period the cargo is to remain at the first depot before re-packaging for further shipment, then sufficient dry ice is added to the EPS container to maintain the cargo below the threshold temperature for the first additive period;

determining and providing the EPS container with dry ice estimated as sufficient to reach a next additional depot while maintaining the mRNA vaccine cargo below the threshold temperature based on the predicted period for shipment of the cargo to the next additional depot, the predicted ambient temperature, the wall thickness and surface area of the in the EPS container, as determined from the relationship between the dry ice sublimation rate in EPS containers of varying wall thickness and surface area at varying ambient temperature for varying periods of time;

monitoring ambient temperature experienced by the EPS container during shipment to the next additional depot;

if the ambient temperature is greater than a specified temperature for a specified period determined heuristically, such that insufficient dry ice is predicted to be present to maintain the cargo below the threshold temperature to a further additional depot where dry ice is available, then: sufficient dry ice is added to the EPS container to maintain the cargo below the threshold temperature to the further additional depot; and, ordering additional dry ice automatically for the further additional depot, if insufficient dry ice is predicted to be present at the further additional depot to maintain the cargo below the threshold temperature for shipment another further additional depot.

2. The method of claim 1 wherein the dry ice estimated as sufficient to reach the first depot is further based on the ambient humidity, and the relationship between the dry ice sublimation rate is also determined heuristically based on ambient humidity.

3. The method of claim 1 wherein the actual ambient temperature of the EPS container is transmitted to a server which uses it to determine whether insufficient dry ice is predicted to be present to cool the cargo sufficiently for the additive period.

4. The method of claim 2 wherein the actual ambient temperature and humidity experienced by the EPS container is transmitted to a server which uses it to determine whether insufficient dry ice is predicted to be present to cool the cargo sufficiently for the additive period.

5. The method of claim 1 further including automatically charging the customer for the package at one of the depots.

6. The method of claim 1 wherein the heuristic determination of sublimation rate is by constructing a series of sublimation plots from experimental data having sublimation rate as one axis, and three other dimensional axes: time, EPS container surface area and wall thickness, and ambient temperature.

7. The method of claim 6 wherein the sublimation plots also include ambient humidity.

8. The method of claim 1 wherein the monitoring of the actual ambient temperature for the EPS container during shipment uses a temperature monitor under control of an internally or externally stored program.

9. The method of claim 1 wherein if the temperature monitor indicates that actual ambient temperature determined by the temperature monitor is greater than a specified temperature for a specified period and humidity, such that the cargo is likely spoiled, an indicator associated with the temperature monitor gives an indication.

10. The method of claim 1 wherein the temperature monitor is capable of indicating that the ambient temperature or ambient temperature and humidity did not exceed specified thresholds for specified periods, and that the cargo is acceptable for use.

11. The method of claim 1 wherein the temperature monitor is capable of indicating additional dry ice should be added to the container.

12. The method of claim 1 further including automatically charging the customer for the package at the final destination.

13. The method of claim 1 further including using indicators to show when to reject a vaccine shipment or send it for immediate opening and administration.

14. The method of claim 13 wherein the indicators can indicate failure of the monitoring system through lack of sufficient battery charge or memory capacity.

* * * * *